US007729101B2

(12) United States Patent
Gefter

(10) Patent No.: US 7,729,101 B2
(45) Date of Patent: Jun. 1, 2010

(54) METHOD AND APPARATUS FOR MONITORING AND CONTROLLING IONIZING BLOWERS

(75) Inventor: Peter Gefter, South San Francisco, CA (US)

(73) Assignee: MKS, Ion Systems, Alameda, CA (US)

( * ) Notice: Subject to any disclaimer, the term of this patent is extended or adjusted under 35 U.S.C. 154(b) by 416 days.

(21) Appl. No.: 11/998,767

(22) Filed: Nov. 30, 2007

(65) Prior Publication Data

US 2008/0130191 A1 Jun. 5, 2008

Related U.S. Application Data

(60) Provisional application No. 60/872,677, filed on Dec. 4, 2006.

(51) Int. Cl.
*H01T 23/00* (2006.01)

(52) U.S. Cl. ..... 361/231; 361/230; 361/233

(58) Field of Classification Search ..... 361/230, 361/231, 233
See application file for complete search history.

(56) References Cited

U.S. PATENT DOCUMENTS 4,160,908 A * 7/1979 Phillips ..... 250/381
6,850,403 B1 * 2/2005 Gefter et al. ..... 361/230

* cited by examiner

*Primary Examiner*—Stephen W Jackson
*Assistant Examiner*—Tien Mai
(74) *Attorney, Agent, or Firm*—John E. Menear

(57) ABSTRACT

An apparatus and method for monitoring the output of an ionizing blower. A measuring channel captures a portion of the air ion stream, and measures balance plus air ion current. Since the measurement channel is isolated from extraneous electrostatic fields, measurements contain less analytical noise. Air flow through the measurement chamber is created by the inherent pressure difference between the high pressure and low pressure sides of an air mover. Two electrodes inside the measurement chamber are combined with a power supply, a low current amplifier, and a controller. The controller also makes adjustments to the ionizing blower.

25 Claims, 1 Drawing Sheet

METHOD AND APPARATUS FOR MONITORING AND CONTROLLING IONIZING BLOWERS

CROSS-REFERENCE TO RELATED APPLICATIONS

This application claims priority to U.S. Provisional Application No. 60/872,677 entitled "METHOD AND APPARATUS FOR MONITORING AND CONTROLLING IONIZING BLOWERS" filed on Dec. 4, 2006.

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to static charge neutralizers, which are designed to remove or minimize static charge accumulation. Static charge neutralizers remove static charge by generating air ions and delivering those ions to a charged target.

One specific category of static charge neutralizer is the ionizing blower. An ionizing blower normally generates air ions with a corona electrode, and uses a fan (or fans) to direct air ions toward the target of interest.

Monitoring or controlling the performance of a blower utilizes two measurements.

The first measurement is balance. Ideal balance occurs when the number of positive air ions equals the number of negative air ions. On a charge plate monitor, the ideal reading is zero. In practice, the static neutralizer is controlled within a small range around zero. For example, a static neutralizer's balance might be specified as 0±2 volts.

The second measurement is air ion current. Higher air ion currents are useful because static charges can be discharged in a shorter time period. Higher air ion currents correlate with low discharge times that are measured with a charge plate monitor.

In practice, charge plate monitors are not used for continuous monitoring or feedback control. The expense would be prohibitive.

This instant invention describes a practical method and apparatus for monitoring and controlling ionizing blowers.

2. Description of Related Art

There are many sensors suggested to monitor and control ionizing blowers. The two most common sensors are: (1) a conductive grid connected to a low current amplifier, and (2) a three electrode combination.

The conductive grid sensor measures air ion current, and uses this information to assess ion balance. The conductive grid works, but it possesses disadvantages.

One disadvantage of the conductive grid sensor is that the conductive grid consumes a large fraction (as much as 30%) of the blower's air ion output. Hence, the blower operates at a low efficiency.

A second disadvantage of the conductive grid sensor is its response to environmental interference. The grid sensor is exposed to external electric fields, which induce unwanted currents that contribute noise to the measurement. Fans, heaters, lights, and motors are examples of devices which generate electric fields. In the presence of environmental interference, both accuracy and sensitivity are compromised.

Any attempt to shield the grid sensor from external electric fields creates an obstacle to air flow. It also makes the blower larger. Moving the grid away from electric field generators limits installation options.

A third disadvantage of the conductive grid sensor is that it can only measure net current. And net current contains no information concerning total ion output. For example, 110 nanoamps of positive air ion flow and 100 nanoamps of negative air ion flow would read 10 nanoamps of positive air ion flow. And 15 nanoamps of positive air ion flow and 5 nanoamps of negative air ion flow would also read 10 nanoamps of positive air ion flow.

A three electrode sensor can measure balance and air ion current. This sensor comprises of two reference electrodes and one voltage or current sensitive electrode. However, it has the same disadvantages as the grid sensor, such as high sensitivity to electrical noise.

A new type of sensor is needed for monitoring and controlling ionizing blowers. The new sensor should measure balance and air ion current. And it should be insensitive to environmental interference.

BRIEF SUMMARY OF THE INVENTION

This present invention takes a sample of ionized air from the blower's output, and measures that sample inside a measurement channel which is isolated from external electric fields. Isolation of the measurement channel is achieved with an outside electrostatic grounded screen, film, or coating positioned over an inner insulative flow path.

The insulative inner flow path is designed to maintain analytical integrity. Only ions that are purposely sampled will be measured. Ions outside the measurement channel walls cannot migrate through the walls, and do not affect the measurement process. And ions inside the channel are not lost at the walls.

The grounded conductive outside surface prevents charge buildup onto the outside walls. Outside charge buildup would cause measurement interference because insulators (the inner insulative flow path) do not attenuate electric fields. Ions in the flow path are either attracted or repelled by electric fields. Grounding outside keeps the measurement channel neutral.

The measurement channel is open only at the entrance and exit ends. The walls are not porous.

The measurement channel is constructed as a bypass air channel, and is positioned between the blower's inlet side and the blower's outlet side. Air flow through the measurement channel is driven by the differential pressure created by the fan (or other air mover). The blower outlet side is a high pressure zone, and the blower inlet side is a low pressure zone.

The measurement channel contains a first electrode that (1) uses a positive voltage to remove negative air ions or (2) uses a negative voltage to remove positive air ions or (3) uses zero voltage to leave the air ion sample unaltered. All air ions that pass the first electrode are captured by the second electrode.

If the first electrode is at zero voltage, the second electrode measures balance. If the first electrode is at positive voltage, the second electrode measures negative ion current. If the first electrode is at negative voltage, the second electrode measures positive ion current.

With accurate information on balance, positive ion current, and negative ion current, the controller can make precise corrective adjustments to the ionizing blower.

The present invention is useful for most types of ionizing blowers.

Objects of this inventions include:

(1) measure and adjust blower balance; (2) measure and adjust the blower's positive air ion density; (3) measure and adjust the blower's negative air ion density; and (4) exclude environmental noise from the measurements.

DETAILED DESCRIPTION

Figure 1:
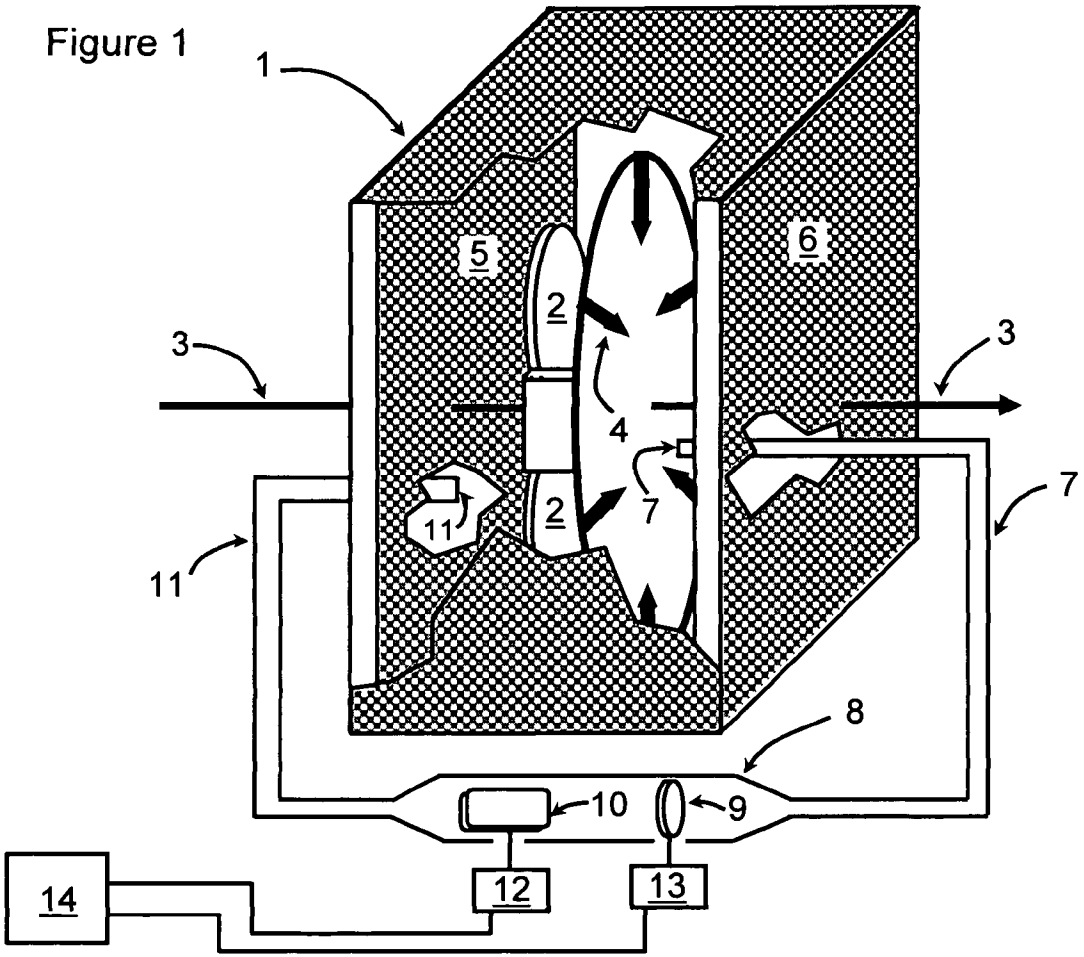
FIG. 1 is a diagram of an ionizing blower that has been modified with the invented feedback.

FIG. 1 shows an example of the inventive concept applied to an ionizing blower 1. The ionizing blower 1 has an inlet side 5 and an outlet side 6. Air flows through the blowing ionizer 1 along air flow direction 3.

A fan 2 (or other air mover) sucks air into the blowing ionizer 1 through the inlet side 5. The inlet side 5 comprises the low pressure side (relative to the surrounding room) because the fan pulls air from this region.

The high pressure side of the blowing ionizer 1 is the outlet side 6 because the fan 2 blows air toward this region. As shown in FIG. 1, the emitters 4 are downwind from the fan 2. However, the current invention also works when the emitters 4 are upwind from the fan 2. Air ions are produced by the emitters 4, and the air ions exit via the outlet side 6.

A measurement channel 8 receives ionized air through the sampling device 7 from the outlet side 6 of the ionizing blower 1. Air from the measurement channel 8 is returned to the inlet side 5 of the ionizing blower 1 through exit device 11. The differential pressure across the measurement channel 8 creates the air flow through the measurement channel 8. No separate air mover is typically needed. However, a separate air mover may be added.

Most blower fans produce enough pressure differential (outlet side minus inlet side) to create a useful air velocity through the measurement channel. For example, a pressure differential of 0.005 inches of water creates a velocity of roughly 280 feet/minute through an unrestricted measurement channel 8.

Inside the measurement channel 8 are a first electrode 9 and a second electrode 10. The first electrode 9 (sometimes ring shaped) is attached to a power supply 13. A typical power supply 13 can supply between +1000 and −1000 volts to the first electrode 9, but this is not intended as a power supply specification. Normally, ±100 volts is sufficient. The second electrode 10 may be constructed as a small metal filter, which acts as an ion trap. This second electrode 10 is connected to the input of a low current amplifier 12.

A controller 14 directs the measurement of balance and air ion current. Balance and air ion currents are measured in separate time periods, and each time period requires different voltages on the power supply 13.

Both the power supply 13 (attached to the first electrode) and the low current amplifier 12 (connected to the second electrode are further connected to a controller 14.

To measure balance, the first electrode 9 is held at zero voltage relative to ground. In this condition, the first electrode 9 does not purposely remove ions from the air stream. Practically, all air ions are trapped at the second electrode 10 which is attached to a low current amplifier 12. If the ionizing blower 1 has a positive balance, the low current amplifier 12 reports a positive current. If the ionizing blower 1 has a negative balance, the low current amplifier 12 reports a negative current. Zero current through the low current amplifier 12 indicates zero (ideal) balance.

To measure ion current, a voltage (perhaps 100 volts or less) is applied to the first electrode 9 through a power supply 13. When a positive voltage is applied by the power supply 13, negative air ions are neutralized at the first electrode 9. Hence, only the positive ions are trapped by the second electrode 10 and measured by the low current amplifier 12. When a negative voltage is applied by the power supply 13, positive ions are neutralized at the first electrode 9, and only the negative ions are trapped by the second electrode 10 and measured by the low current amplifier 12.

I claim:

1. An ionizing blower with air ion monitoring comprising:
- an ionizer chassis;
- a high voltage power source;
- an air mover disposed within said chassis which creates air flow through said ionizing blower;
- ion emitters positioned in the path of said air flow
  - wherein voltage on said ion emitters is determined by said high voltage power source;
- a measurement device including
  - a measurement channel that is only open at entrance and exit segments wherein the measurement channel includes
    - an insulative interior surface to prevent measurement interference from outside ion migration or from through-the-wall leakage currents,
    - a grounded conductive exterior surface to prevent static charge buildup around said measurement channel and to prevent electrostatic field transmission through walls of said measurement channel,
    - a first electrode which receives voltage from a power supply, and
    - a second electrode which couples to a low current amplifier,
  - air sampling device that
    - receives air ions from a high pressure side of said air mover, and
    - connects to the entrance segment of said measurement channel, and
  - an air exit device that
    - returns measured air to a low pressure side of said air mover, and
    - connects to the exit segment of said measurement channel;
- a controller that
  - generates control signals to said power supply to provide predetermined voltages to the first electrode,
  - receives information from the low current amplifier, and
  - provides a feedback signal to said high voltage power source to adjust voltage on said emitters.

2. The ionizing blow of claim 1 wherein said grounded conductive exterior surface is any one of a metal screen, a metal coating, and a wire mesh.

3. The ionizing blower of claim 1 wherein said controller adjusts said power supply to any voltage between −1000 and +1000 volts.

4. The ionizing blower of claim 1 wherein said controller adjusts said power supply to ground potential during balance measurement by said second electrode.

5. The ionizing blower of claim 1 wherein said power supply is adjusted to a positive voltage during measurement of positive air ion current by said second electrode.

6. The ionizing blower of claim 1 wherein said power supply is adjusted to a negative voltage during measurement of negative air ion current by said second electrode.

7. The ionizing blower of claim 1 wherein said controller receives any one of balance data, negative air ion current data, and positive air ion current data from said low current amplifier.

8. The ionizing blower of claim 7 wherein said balance data is received during a time period in which said first electrode is held at ground potential.

9. The ionizing blower of claim 7 wherein said positive air ion current data is received during a time period in which said first electrode is held at a positive potential.

10. The ionizing blower of claim 7 wherein said negative air ion current data is received during a time period in which said first electrode is held at a negative potential.

11. The ionizing blower of claim 7 wherein said controller adjusts operating parameters of said ionizing blower via a control signal to said ionizer's variable high voltage source.

12. The ionizing blower of claim 11 wherein said operating parameters include any one of ion emitter voltage, emitter current, emitter on-time, and emitter off-time.

13. The ionizing blower of claim 1 wherein flow through said measurement channel is created by the pressure difference between said high pressure side of said air mover and said low pressure side of said air mover.

14. The ionizing blower of claim 1 wherein said air mover comprises a fan.

15. The ionizing blower of claim 1 wherein said ion emitters comprise corona electrodes.

16. A method of measuring balance and air ion current for an ionizing blower comprising:

beginning with an ionizing blower which includes
- an ionizer chassis;
- a high voltage power source;
- an air mover disposed within said chassis which creates air flow through said ionizing blower;
- ion emitters positioned in the path of said air flow
  - wherein voltage on said ion emitters is determined by said high voltage power source;

adding a measuring device which includes
- a measurement channel that is only open at entrance and exit segments wherein the measurement channel includes
  - an insulative interior surface to prevent measurement interference from outside ion migration or from through-the-wall leakage currents,
  - a grounded conductive exterior surface to prevent static charge buildup around said measurement channel and to prevent electrostatic field transmission through walls of said measurement channel,
- a first electrode which receives voltage from a power supply, and
- a second electrode which couples to a low current amplifier, air sampling device that
- receives air ions from a high pressure side of said air mover, and
- connects to the entrance segment of said measurement channel, and an air exit device that
- returns measured air to a low pressure side of said air mover, and
- connects to the exit segment of said measurement channel;

controlling the modified ionizing blower with a controller that
- generates control signals to said power supply to provide predetermined voltages to the first electrode,
- receives information from the low current amplifier, and
- provides a feedback signal to said high voltage power source to adjust voltage on said ion emitters.

17. The method of claim 16 wherein said air mover is a fan.

18. The method of claim 16 wherein said second electrode measures air ion balance when said controller sets said first electrode to ground potential.

19. The method of claim 16 wherein said second electrode measures positive air ion current when said controller sets said first electrode to a positive voltage.

20. The method of claim 16 wherein said second electrode measures negative air ion current when said controller sets said first electrode to a negative voltage.

21. The method of claim 16 wherein said controller is connected to both said power supply and said low current amplifier.

22. The method of claim 16 wherein any one of emitter voltage, emitter current, emitter on-time, and emitter off-time is used to generate said feedback signal.

23. The method of claim 16 wherein said first and second electrodes have different shapes.

24. The method of claim 16 wherein said first electrode has low resistance to air ion flow or is configured as a ring.

25. The method of claim 16 wherein said second electrode is positioned downstream to said first electrode and configured as an ion trap.

* * * * *